US012201231B1

(12) United States Patent
Wilkes

(10) Patent No.: US 12,201,231 B1
(45) Date of Patent: Jan. 21, 2025

(54) INSULATED BEVERAGE HOLDER WITH FREEZABLE GEL LAYER FOR EXTENDED COLD RETENTION

(71) Applicant: Theodore Wilkes, Stone Mountain, GA (US)

(72) Inventor: Theodore Wilkes, Stone Mountain, GA (US)

( * ) Notice: Subject to any disclaimer, the term of this patent is extended or adjusted under 35 U.S.C. 154(b) by 0 days.

(21) Appl. No.: 18/657,833

(22) Filed: May 8, 2024

(51) Int. Cl.
*A47G 23/02* (2006.01)

(52) U.S. Cl.
CPC ..... *A47G 23/0241* (2013.01); *A47G 23/0266* (2013.01); *A47G 2023/0275* (2013.01)

(58) Field of Classification Search
CPC ..... A47G 23/0241; A47G 23/0266; A47G 2023/0275; Y10S 220/903; B65D 81/3886; B65D 23/106
See application file for complete search history.

(56) References Cited

U.S. PATENT DOCUMENTS 3,703,816 A * 11/1972 Weathers ..... F25D 3/08 62/457.4
4,735,333 A * 4/1988 Lay ..... A47G 23/0233 D7/511
4,966,303 A * 10/1990 Jones ..... A47G 23/0266 294/31.2
5,067,328 A 11/1991 Medina et al.
5,156,283 A 10/1992 Sampson
5,189,892 A 3/1993 Roberts
5,609,277 A * 3/1997 McDonald ..... A45F 5/02 224/148.1
6,244,461 B1 * 6/2001 Roberts ..... A47G 23/0233 220/741
9,526,364 B1 12/2016 Lovison
9,605,894 B2 3/2017 Christian
9,930,982 B2 4/2018 Matsui
2004/0079720 A1 4/2004 Croskrey
2012/0305571 A1 * 12/2012 Larsen ..... A47G 23/0233 220/592.17
2014/0263336 A1 9/2014 Hicks et al.
2016/0022069 A1 1/2016 Martin
2018/0072461 A1 3/2018 Lane, II et al.
2019/0322440 A1 * 10/2019 Tarbutton ..... A47G 23/0233

OTHER PUBLICATIONS

CN 217625134, see attached translation NPL, Oct. 21, 2022.*

* cited by examiner

*Primary Examiner* — Frantz F Jules
*Assistant Examiner* — Martha Tadesse
(74) *Attorney, Agent, or Firm* — Gugliotta & Gugliotta, LPA

(57) ABSTRACT

An insulated beverage holder designed to maintain the cold temperature of canned or bottled beverages for an extended period. The holder features a double-walled construction with an inner freezable gel layer and an outer insulating Styrofoam layer. The gel layer can be frozen prior to use, creating a cold environment that prolongs the desired drinking temperature. Adjustable compression rings secure various container sizes. The holder includes a side handle, customizable outer wrap, and an alternate version with canvas straps and Velcro handle. Manufactured using readily available materials and methods, this invention provides a practical solution for maintaining the cold temperature of beverages during consumption, addressing the limitations of traditional koozies.

22 Claims, 9 Drawing Sheets

INSULATED BEVERAGE HOLDER WITH FREEZABLE GEL LAYER FOR EXTENDED COLD RETENTION

RELATED APPLICATIONS

There are no previously filed, nor currently any co-pending applications, anywhere in the world.

BACKGROUND OF THE INVENTION

1. Field of the Invention

The present invention relates generally to insulated beverage holders and, in particular, to an insulated beverage holder that utilizes a freezable gel layer to maintain the cold temperature of canned or bottled beverages for an extended period, addressing the limitations of traditional koozies.

2. Description of the Related Art

Insulated beverage holders, commonly referred to as "koozies," have been widely used to maintain the temperature of canned beverages. These holders are designed to provide insulation between the beverage can and the ambient environment, as well as the user's hand, which can transfer heat to the beverage. However, traditional koozies have several limitations that affect their effectiveness in keeping beverages cold for extended periods.

This results in a number of existing problems and needs, including:

- Low Insulation Value: Standard koozies offer minimal insulation due to their thin, lightweight materials. This results in a rapid heat transfer from the surrounding environment to the beverage, causing it to warm up quickly.
- Room Temperature Starting Point: Koozies are typically stored at room temperature, which means that when a cold beverage is placed inside, the koozie itself begins to warm the beverage immediately. This further contributes to the rapid temperature increase of the beverage.
- Short Cooling Duration: Due to the low insulation value and room temperature starting point, beverages in traditional koozies start to lose their desirable cold temperature within a short period. Users are often left with the option of consuming the beverage at an unsatisfactory temperature or discarding it.
- Lack of Rechilling Options: Once a beverage in a koozie has warmed up, users have limited options to re-chill it. Adding ice to a canned beverage is impractical, and placing the beverage back in a refrigerator would require waiting for an extended period before it returns to a desirable temperature.
- Need for Extended Cooling: There is a need for an insulated beverage holder that can maintain a cold temperature for a significantly longer duration, allowing users to enjoy their beverages at a refreshing temperature throughout their consumption.

Consequently a need exists for a solution that addresses the limitations of traditional koozies.

SUMMARY OF THE INVENTION

It is thus an object of the present invention to provide an insulated beverage holder that utilizes a freezable gel layer to maintain the cold temperature of canned or bottled beverages for an extended period, overcoming the limitations of traditional koozies.

It is a feature of the present invention to incorporate a freezable gel layer. By placing in a freezer prior to use, the gel layer freezes, creating a cold environment that surrounds the beverage can. This frozen layer effectively maintains the beverage's cold temperature for an extended period, significantly longer than what is possible with standard koozies.

Briefly described according to a preferred embodiment of the present invention, an insulated beverage holder is provided designed to maintain the cold temperature of canned or bottled beverages for an extended period. The beverage holder comprises a cylindrical body with a hinged lid, resembling a beer stein. The body features a double-walled construction, with an inner layer of freezable gel and an outer layer of insulating Styrofoam. The gel layer can be frozen prior to use, creating a cold environment that surrounds the beverage container and effectively prolongs the desired drinking temperature. Adjustable compression rings with spring finger slots are incorporated into the design to secure various beverage container sizes. The beverage holder also includes a large side handle for comfortable handling and a customizable outer plastic wrap layer for displaying logos, advertisements, or personalized designs. An alternate version with durable canvas straps and an adjustable Velcro handle is available for added flexibility and convenience. The insulated beverage holder is manufactured using readily available materials and known methods, such as injection molding, ensuring cost-effective production and market feasibility. By addressing the limitations of traditional koozies, this invention provides a practical solution for maintaining the cold temperature of beverages during consumption, without the need for frequent replacements or refrigeration.

The preferred embodiment of the present invention includes a Styrofoam outer layer for additional insulation and a beer stein-inspired aesthetic, provides a practical and appealing solution to the problems associated with traditional beverage holders. It enables users to enjoy their cold beverages at a desirable temperature for a longer duration without the need for frequent replacements or reliance on refrigeration.

It is an advantage of the present invention to provide an insulated beverage holder that maintains the cold temperature of canned or bottled beverages for an extended period, significantly longer than traditional koozies.

It is another advantage of the present invention to incorporate a freezable gel layer that can be frozen prior to use, creating a cold environment surrounding the beverage container and effectively prolonging the desired drinking temperature.

It is an advantage of the present invention to offer a solution that eliminates the need for frequent beverage replacements or reliance on refrigeration to maintain a refreshing drinking experience.

It is another advantage of the present invention to feature a double-walled insulation design, with an inner freezable gel layer and an outer Styrofoam layer, enhancing the thermal insulation properties of the beverage holder.

It is an advantage of the present invention to provide a secure and stable fit for various beverage container sizes using adjustable compression rings with spring finger slots.

It is another advantage of the present invention to offer an appealing, beer stein-inspired aesthetic with a large side handle, flip-up hinged lid, and decorative bands, enhancing the user experience and visual appeal.

It is an advantage of the present invention to include a customizable outer plastic wrap layer that allows for printing logos, advertisements, or personalized designs, making it suitable for promotional purposes or personal preferences.

It is another advantage of the present invention to provide an alternate version with durable canvas straps and an adjustable Velcro handle, offering flexibility and convenience in handling the beverage holder.

It is an advantage of the present invention to utilize readily available materials and known manufacturing methods, such as injection molding, ensuring cost-effective production and market feasibility.

Further objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

The best mode for carrying out the invention is presented in terms of its preferred embodiment, herein depicted within the Figures.

1. Detailed Description of the Figures

Figure 1:
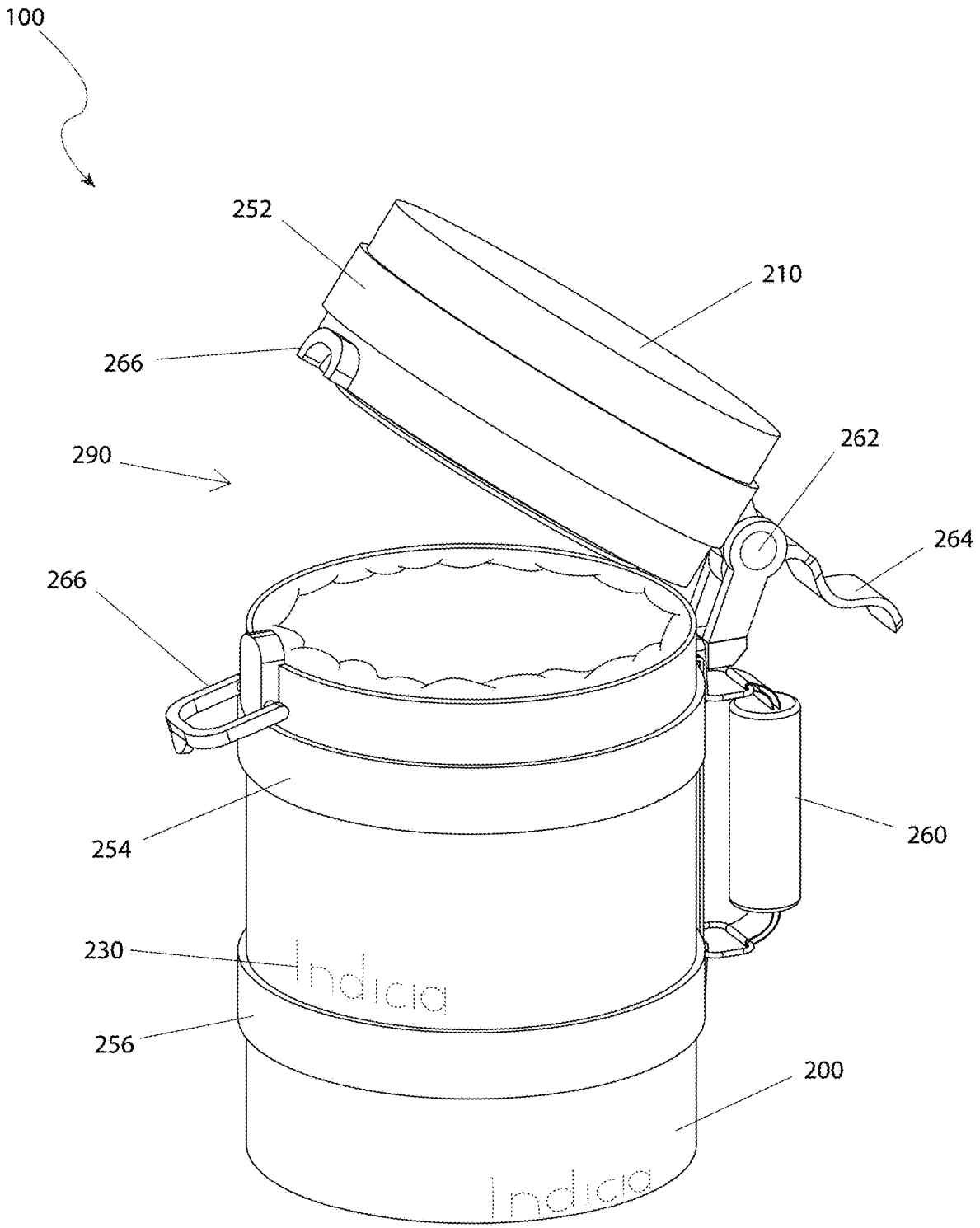
FIG. 1 is a left isometric view of a stein cooler 100, according to an embodiment of the present invention, illustrating a cap 210 in an open position 290.
Figure 2:
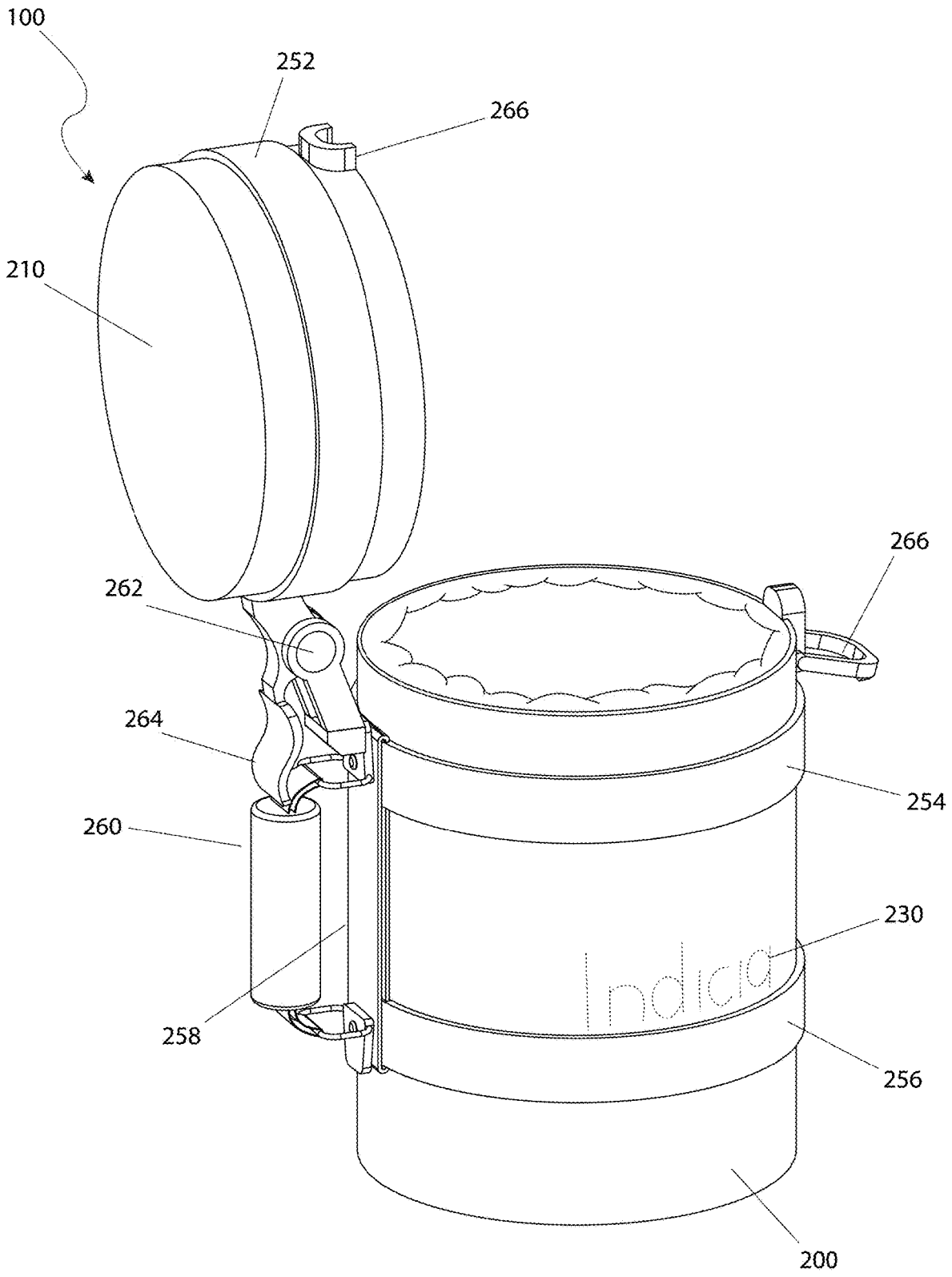
FIG. 2 is a right isometric view of the stein cooler 100, according to an embodiment of the present invention, illustrating the cap 210 in a fully open position 290.
Figure 3:
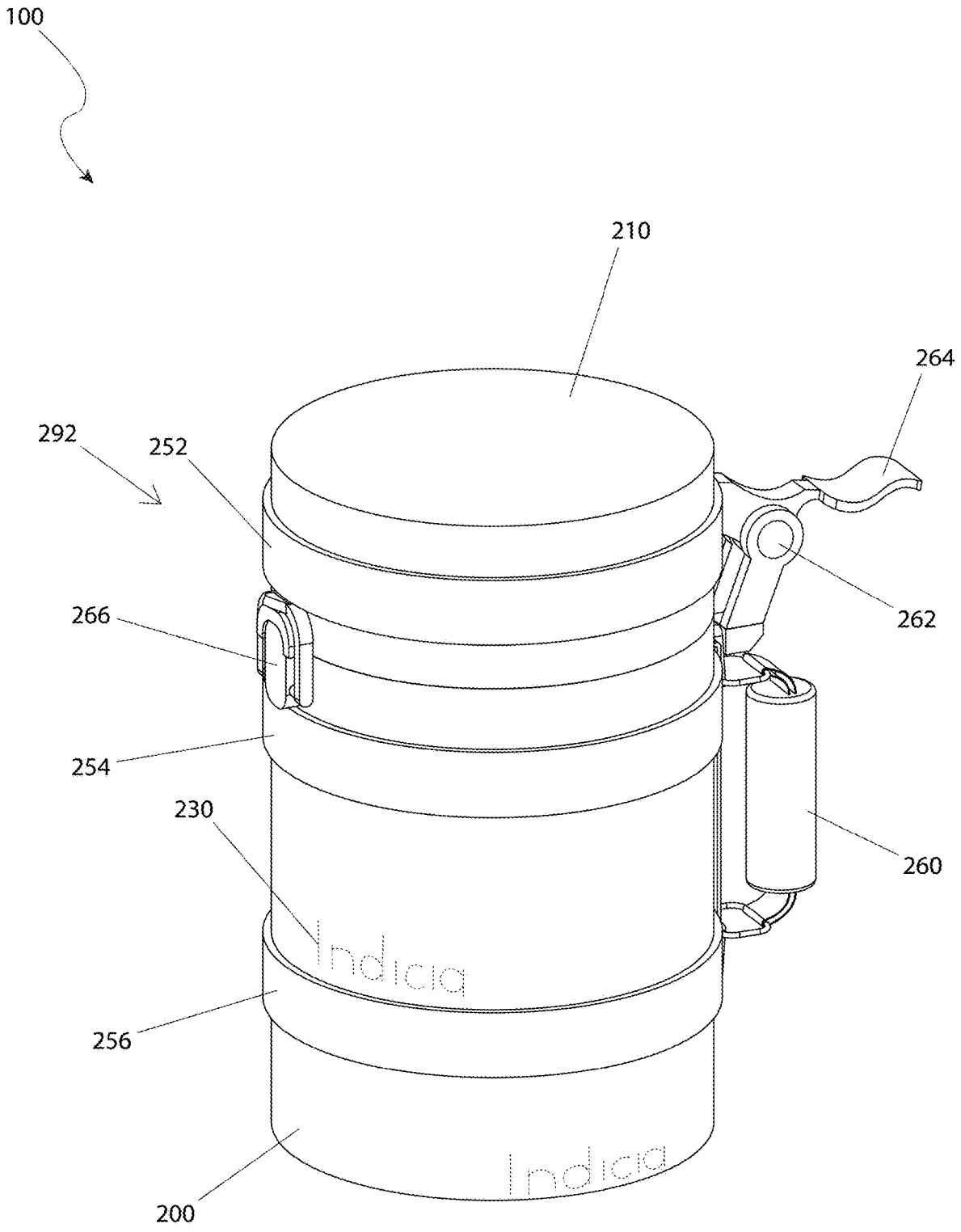
FIG. 3 is a left isometric view of the stein cooler 100, according to an embodiment of the present invention, illustrating the cap 210 in the closed position 292.
Figure 4:
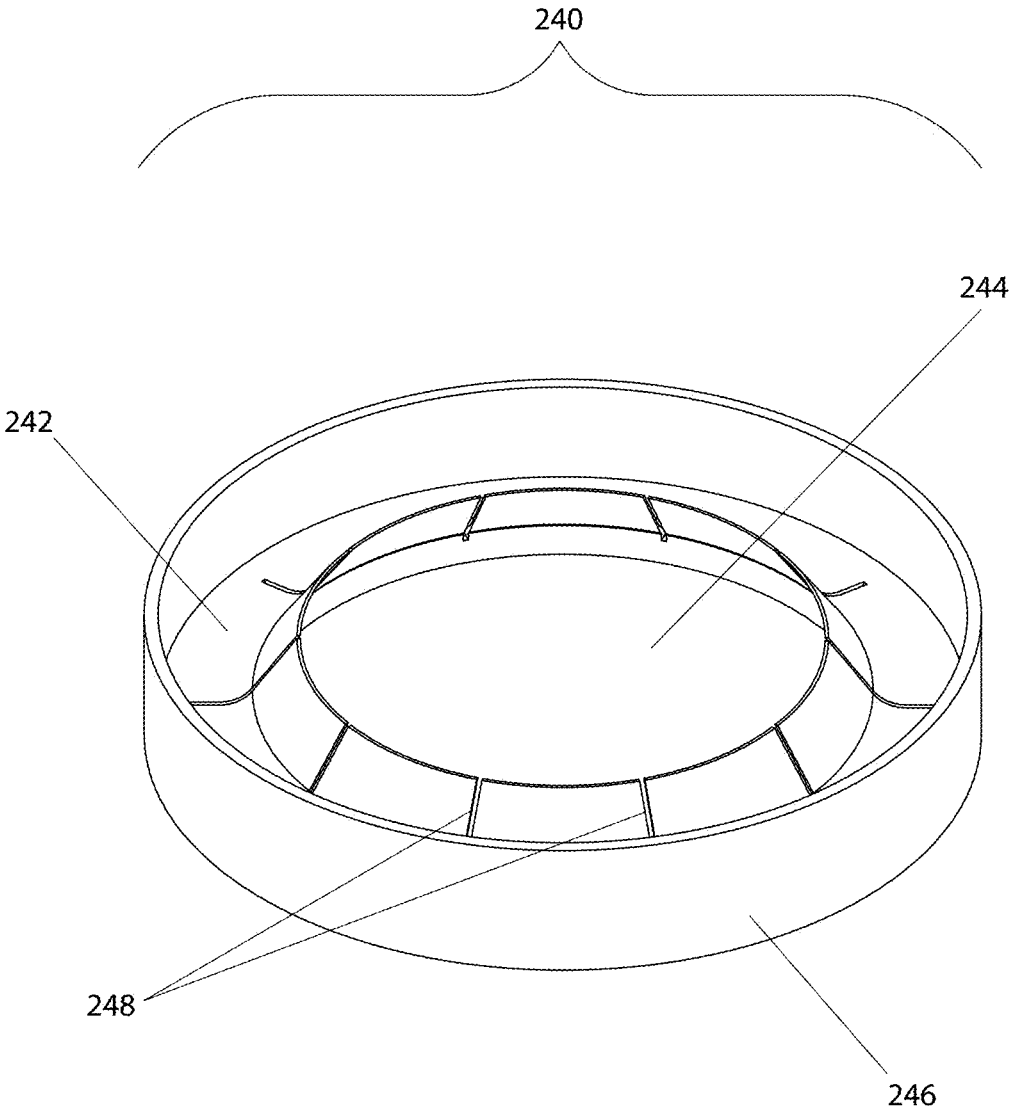
FIG. 4 is an isometric view of an individual compression ring 240, according to an embodiment of the present invention.
Figure 5:
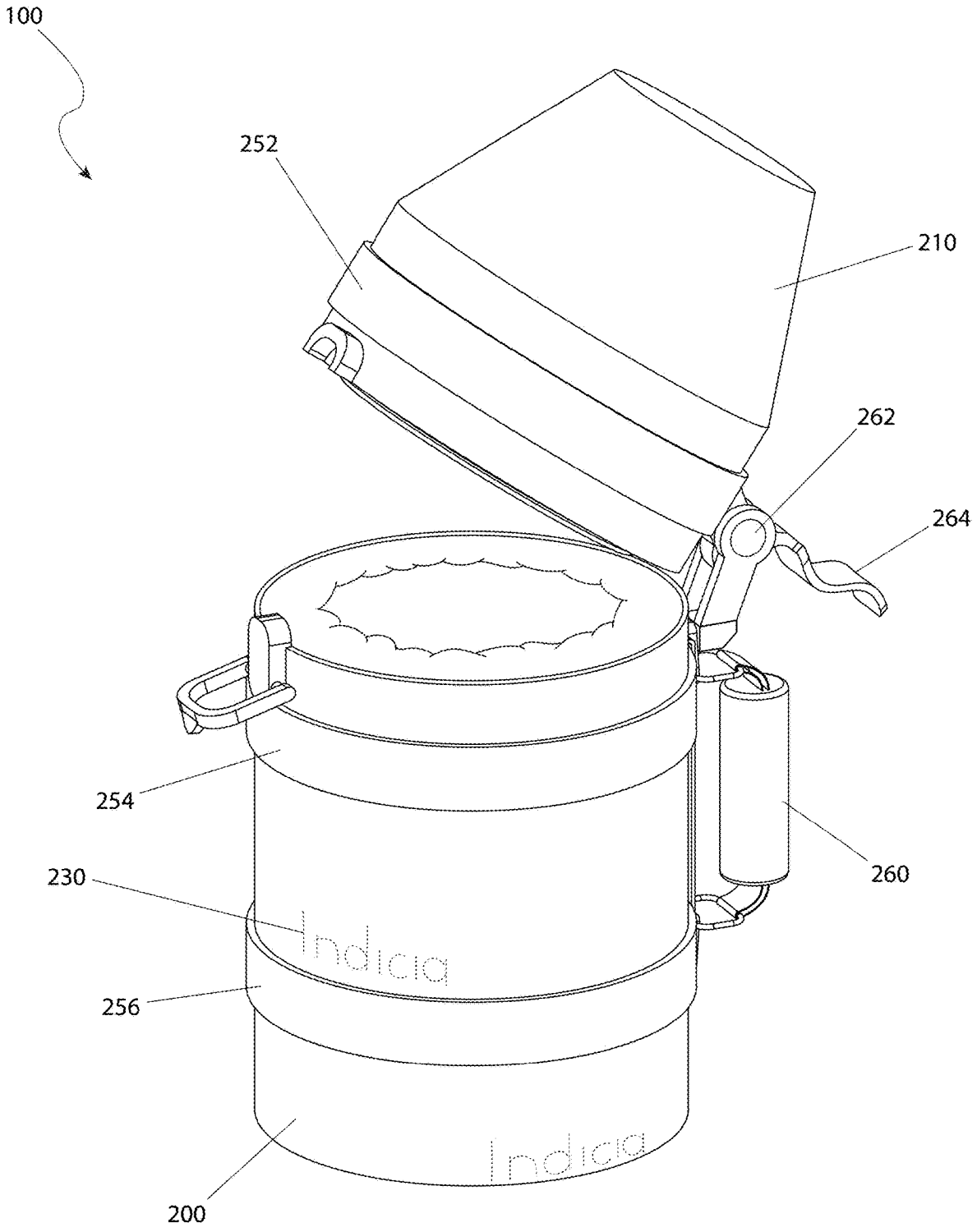
FIG. 5 is a left isometric view of the stein cooler 100, according to an alternative embodiment of the present invention.
Figure 6:
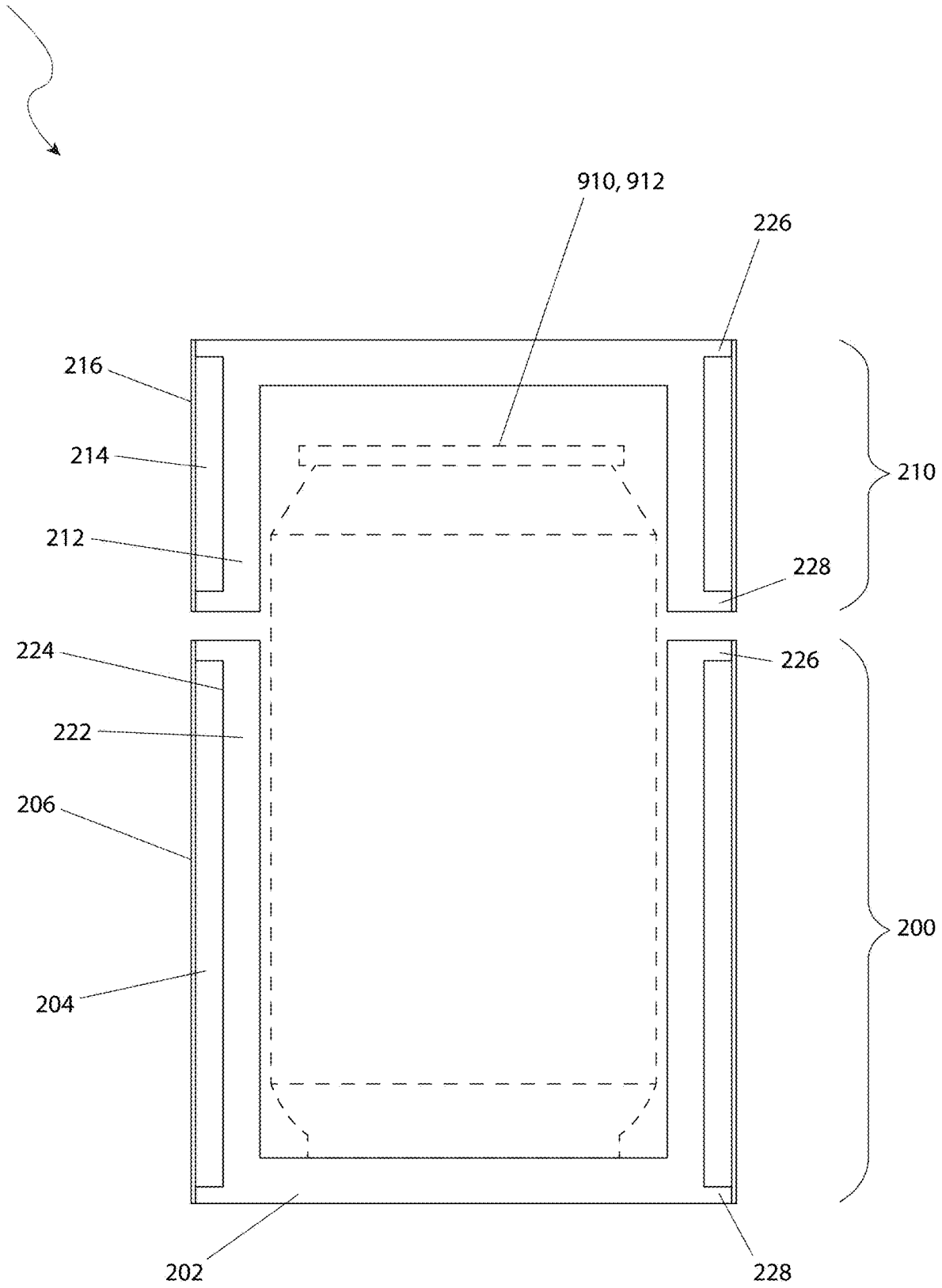
FIG. 6 is a detail view of the stein cooler 100, according to an embodiment of the present invention, illustrating the cap 210 appropriate for enclosing a can 912.
Figure 7:
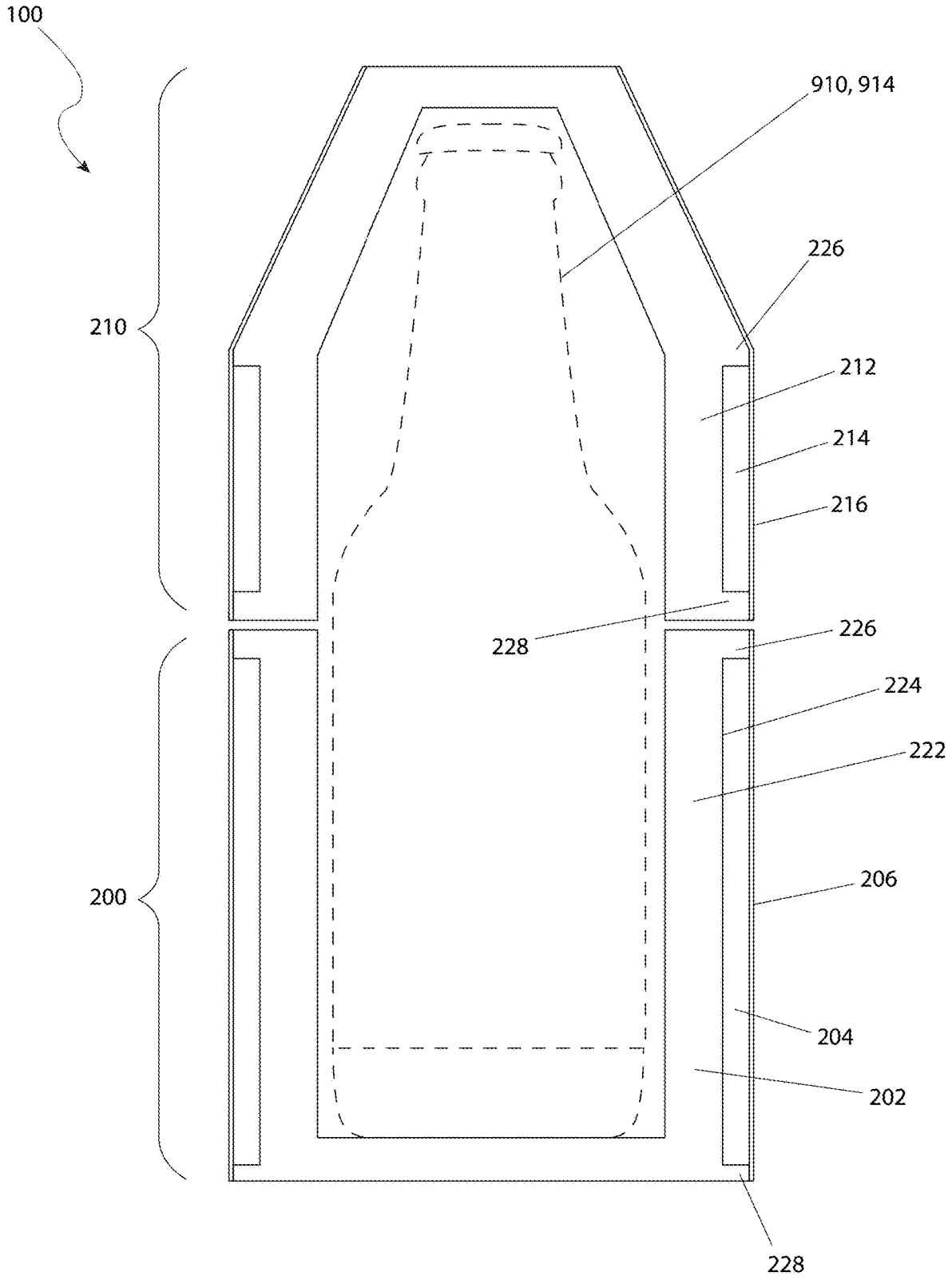
FIG. 7 is a detail view of the stein cooler 100, according to an alternative embodiment of the present invention, illustrating the cap 210 appropriate for enclosing a bottle 914.
Figure 8:
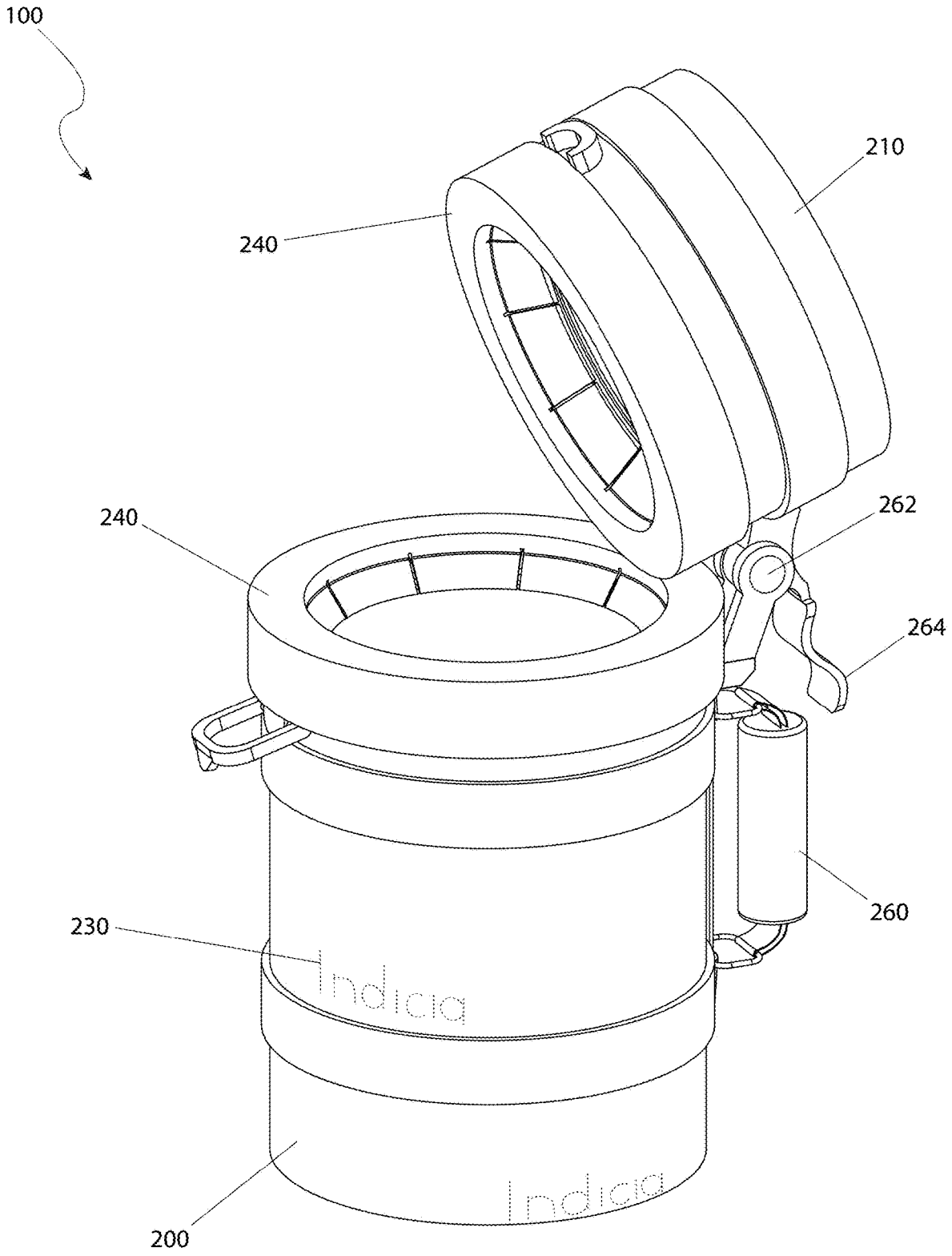
FIG. 8 is a left isometric view of the stein cooler 100, according to an embodiment of the present invention, illustrating a pair of compression rings 240 in place; and, FIG. 9 is a detail view of the stein cooler 100, according to an embodiment of the present invention, illustrating an embodiment where the base gel pack 202 is capable of being removable from the base 200 and the cap gel pack 212 is capable of being removable from the cap 210.
Figure 9:
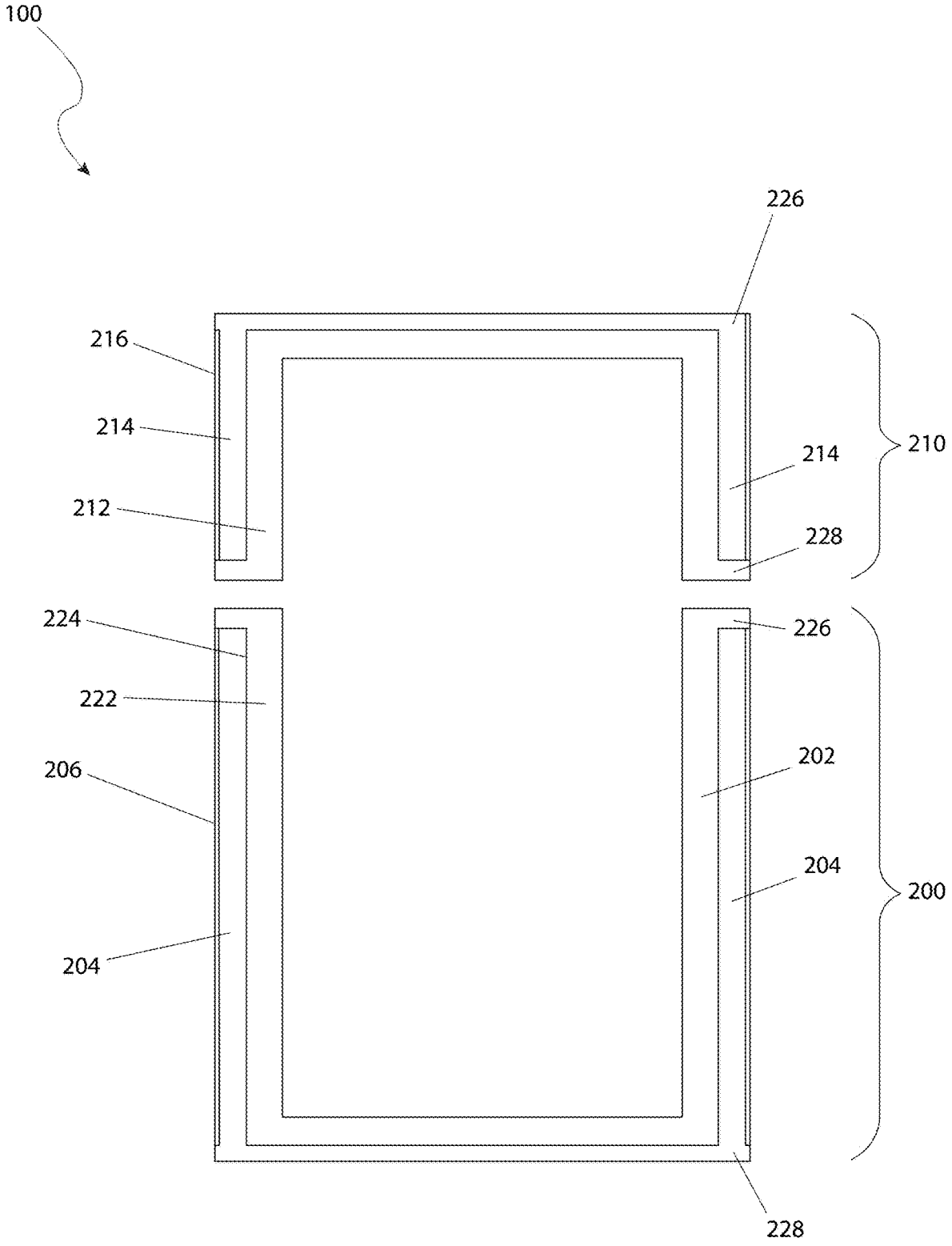

Referring now to the drawings, wherein like reference numerals indicate the same parts throughout the several views, a stein cooler (herein described as the "invention") 100, is shown according to a preferred embodiment of the present invention. The invention 100 may comprise a base 200, a cap 210, a plurality of retaining bands 252, 254, 256, an adjustable handle 260, a hinge 262, and a cap lock 266. The base 200 and the cap 210 may be hingedly coupled to form an enclosure of the invention 100 for cooling a beverage container 910. The enclosure of the invention 100 may resemble a drinking stein. Gel packs 202, 212 located within the enclosure of the invention 100 may surround the beverage container 910 with a gel material 222 that may be frozen to chill a beverage contained within the beverage container 910. The gel packs 202, 212 such as that illustrated in FIG. 9, may be removable from the enclosure of the invention 100. Insulators 204, 214 surrounding the gel packs 202, 212 may thermally insulate the gel packs 202, 212 and the beverage container 910. The plurality of retaining bands 252, 254, 256, the hinge 262, and the handle 260 may pivotably couple the base 200 and the cap 210 and may enhance the drinking stein appearance. The cap lock 266 may secure the cap 210 to the base 200. As non-limiting examples, the beverage container 910 may be a can 912 or a bottle 914 and therefore the invention 100 shall be sized to fully accommodate the size, shape of the beverage container 910.

The base 200 may be the lower section of the enclosure. The base 200 may be cylindrical in form and may comprise a hollow core. The hollow core of the base 200 may surround the lower portion of the beverage container 910. The hollow core of the base 200 may be surrounded by a base gel pack 202 which may be frozen in order to chill the beverage container 910. The base gel pack 202 may also cover the bottom side of hollow core. The top of the hollow core may be open to accept the beverage container 910. The base gel pack 202 may be surrounded by a base insulator 204 to thermally insulate the base gel pack 202 from the ambient air temperature of the environment. The base insulator 204 may be surrounded by a base outer plastic liner 206 to protect the base insulator 204. The base gel pack 202 may also be removable or separable from the base insulator 204 to enable replacement and reusability and to be able to be frozen upon demand without having to place the entire stein cooler 100 in a freezer.

The cap 210 may be the upper section of the enclosure. The cap 210 may be cylindrical in form and may comprise a hollow core. The hollow core of the cap 210 may surround the upper portion of the beverage container 910. The hollow core of the cap 210 may be surrounded by a cap gel pack 212 which may be frozen in order to chill the beverage container 910. The cap gel pack 212 may also cover the top side of hollow core. The bottom of the hollow core may be open to accept the beverage container 910. The cap gel pack 212 may be surrounded by a cap insulator 214 to thermally insulate the cap gel pack 212 from the ambient air temperature of the environment. The cap insulator 214 may be surrounded by a cap outer plastic liner 216 to protect the cap insulator 214. Each base gel pack 202 and the cap gel pack 212 may comprise the gel material 222 and a containment shell 224. The containment shell 224 may house and shape the gel material 222. The containment shell 224 may be a double-walled container that may be generally cylindrical and may comprise a hollow center. The gel material 222 may be contained between the double walls of the containment shell 224. The containment shell 224 may comprise an upper lip 226 and a lower lip 228. The upper lip 226 and the lower lip 228 may project away from the center of the containment shell 224 to form rings that may encircle the top and bottom of the containment shell 224. The gel material 222 may be a reusable material that may be frozen and may subsequently chill the beverage located within the beverage container 910.

The base gel pack 202 and the cap gel pack 212 may be frozen by placing the base gel pack 202 and the cap gel pack 212 into a freezer. As a non-limiting example, the enclosure may be opened and placed into the freezer such that the base gel pack 202 and the cap gel pack 212 are both exposed to a freezing temperature. The base gel pack 202 may comprise an overhang or lip on the top perimeter edge thereof and the cap gel pack 212 may comprise an overhang or lip on the bottom perimeter edge thereof. These overhangs or lips assist in enabling removal of the respective base gel pack 202 or cap gel pack 212 by providing a protruding grip.

Each base gel pack 202 and the cap gel pack 212 may comprise the gel material 222 and a containment shell 224. The containment shell 224 may house and shape the gel material 222. The containment shell 224 may be a double-walled container that may be generally cylindrical and may comprise a hollow center. The gel material 222 may be contained between the double walls of the containment shell 224. The containment shell 224 may comprise an upper lip 226 and a lower lip 228. The upper lip 226 and the lower lip 228 may project away from the center of the containment shell 224 to form rings that may encircle the top and bottom of the containment shell 224. The gel material 222 may be a reusable material that may be frozen and may subsequently chill the beverage located within the beverage container 910.

Each of the base insulator 204 and the cap insulator 214 may thermally insulate the individual gel pack 202, 212 from the surrounding air. Each of the base insulator 204 and the cap insulator 214 may be held in place by the upper lip 226 and the lower lip 228 of the containment shell 224 which may prevent each of the base insulator 204 and the cap insulator 214 from sliding up or down. As a non-limiting example, each of the base insulator 204 and the cap insulator 214 may be made of closed-cell polystyrene foam.

Each of the base insulator 204 and the cap insulator 214 may thermally insulate the individual gel pack 202, 212 from the surrounding air. Each of the base insulator 204 and the cap insulator 214 may be held in place by the upper lip 226 and the lower lip 228 of the containment shell 224 which may prevent each of the base insulator 204 and the cap insulator 214 from sliding up or down. As a non-limiting example, each of the base insulator 204 and the cap insulator 214 may be made of closed-cell polystyrene foam.

Each base outer plastic liner 206 and the cap outer plastic liner 216 may be a layer of plastic surrounding the individual insulator 204, 214. Each base outer plastic liner 206 and the cap outer plastic liner 216 may protect the respective base insulator 204 and cap insulator 206 from physical damage. In some embodiments, each base outer plastic liner 206 and the cap outer plastic liner 216 may comprise indicia 230 that may be placed thereon. As non-limiting examples, the indicia 230 may be textual messages, graphics, logos, decorative color schemes, decorative patterns, or any combination thereof.

The plurality of retaining bands 252, 254, 256 may encircle the cap 210 and the base 200 and may enhance the drinking stein appearance. The plurality of retaining bands 252, 254, 256 may comprise a cap retaining band 252, an upper base retaining band 254, and a lower base retaining band 256. The cap retaining band 252 may encircle the cap 210. The upper base retaining band 254 and the lower base retaining band 256 may encircle the base 200 with the upper base retaining band 254 positioned above the lower base retaining band 256. In some embodiments, a vertical stabilizer 258 may maintain the separation distance of the upper base retaining band 254 and the lower base retaining band 256.

The handle 260 may be adapted for a user to grasp while using the invention 100. The handle 260 may be coupled to the upper base retaining band 254 and the lower base retaining band 256. The handle 260 may further be adjustable to enable a more comfortable and fitted grip for a user.

The hinge 262 may pivotably couple the cap 210 to the base 200 such that the cap 210 may move between an open position 290 and a closed position 292. When the cap 210 is in the fully open position 290 relative to the base 200, there should be no interference with consumption of contents within the beverage container 910 when stored within. The hinge 262 may be coupled to the cap retaining band 252 and to the upper base retaining band 254. A thumb lever 264 may be a lever than may be adapted to be moved by the thumb in order to open and close the cap 210.

The cap lock 266 may be a locking mechanism that may retain the cap 210 in the closed position 292 when actuated. As non-limiting examples, the cap lock 266 may be a clasp, catch, latch, or any combination thereof and may operate mechanically or magnetically.

In some embodiments, one (1) or more compression rings 240 may be coupled to the enclosure in order to secure the beverage container 910 within the enclosure. The one (1) or more compression rings 240 may be coupled to the top of the base 200, to the bottom of the cap 210, or both. An individual compression ring 240 may comprise a disk 242 with a central aperture 244, a compression ring lip 246, and a plurality of radial slots 248. The disk 242 may cover the opening in the individual gel pack 202, 212. The central aperture 244 may permit the beverage container 910 to pass through the individual compression ring 240. The plurality of radial slots 248 may be operable to make the disk 242 pliant such that the individual compression ring 240 may fit the beverage container 910. The compression ring lip 246 may retain the individual compression ring 240 to the individual gel pack 202, 212.

The top of the cap 210 may be horizontal and flat to accommodate a can 912. In some embodiments, the cap 210 may be elevated at the center to provide additional interior space for a bottle 914.

In an alternative embodiment, the insulated beverage holder may be designed as an "aftermarket" version that does not fit any particular container size but allows for use with custom poured or blended beverage. In such an embodiment a drink insert may be otherwise provided to allow for such "poured" beverages to be utilized therewith. Similarly, adaptation to fit various bottle sizes using adjustable compression rings or other means is further anticipated. In any embodiment, the cooling elements, such as the base gel pack 202 and the cap gel pack 212, may be removable to allow for easy freezing and insertion into the beverage holder.

2. Operation of the Preferred Embodiment

In use, the base gel pack 202 and the cap gel pack 212 may be frozen in a freezer. The beverage container 910 may be placed into the enclosure and the enclosure may be closed by pivoting the cap 210 to the closed position 292. As non-limiting examples, the beverage container 910 may be a can 912 or a bottle 914. The cap lock 266 may be used to hold the cap 210 closed. The user may drink the beverage from the beverage container 910 by pivoting the cap 210 to the fully open position 290, lifting the enclosure using the handle 260, and dispensing the contents.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples, and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of Warner-Jenkinson Company, v. Hilton Davis Chemical, 520 US 17 (1997) or Festo Corp. v. Shoketsu Kinzoku Kogyo Kabushiki Co., 535 U.S. 722 (2002), or other similar caselaw or subsequent precedent should not be made if any future claims are added or amended subsequent to this patent application.

What is claimed is:

1. A unitary insulated beverage holder for maintaining a cold temperature of a beverage container, comprising: a cylindrical body having a hollow core for receiving the beverage container, the cylindrical body comprising: a base section; and a cap section integrally and hingedly coupled to the base section via a hinge; a freezable gel layer lining an interior of the hollow core and surrounding the beverage container, the freezable gel layer comprising: a base gel pack within the base section; and a cap gel pack within the cap section, wherein each of the base gel pack and the cap gel pack comprises a containment shell housing a gel material; an insulating layer surrounding an exterior of the freezable gel layer; and a locking mechanism comprising a spring-loaded latch with mating parts on the cap section and base section to secure the cap section to the base section in a closed position, wherein the locking mechanism is configured to maintain a pressure seal between the cap section and base section when closed.

2. The insulated beverage holder of claim 1, wherein the containment shell of each of the base gel pack and the cap gel pack is removable from the insulating layer to enable freezing of the gel layer separate from the cylindrical body.

3. The insulated beverage holder of claim 1, further comprising one or more adjustable compression rings coupled to the interior of the hollow core to secure the beverage containers of various sizes, wherein the one or more adjustable compression rings comprise a first silicone gel clasping ring and a second silicone gel clasping ring, each having elasticity to adaptably grip outer walls of the beverage containers of different dimensions.

4. The insulated beverage holder of claim 1, further comprising a handle coupled to an exterior of the base section.

5. The insulated beverage holder of claim 4, wherein the handle is adjustable to enable a fitted grip for a user, the handle comprising:

a support spine;

a top recessed rib at an upper end of the support spine;

a bottom recessed rib at a lower end of the support spine;

wherein the top and bottom recessed ribs are configured to receive fasteners for securing the handle to the cylindrical body at adjustable positions along the cylindrical body.

6. The insulated beverage holder of claim 1, further comprising a plurality of retaining bands encircling an exterior of the cylindrical body to provide a drinking stein appearance wherein the plurality of retaining bands comprise: a top circumferential clamp secured around an upper portion of the cylindrical body; and a bottom circumferential clamp secured around a lower portion of the cylindrical body; wherein each of the top and bottom circumferential clamps includes rearwardly extending ears for attachment to the handle.

7. The insulated beverage holder of claim 1, further comprising an outer customizable layer surrounding the insulating layer, the outer customizable layer configured to receive printed indicia.

8. The insulated beverage holder of claim 1, wherein the insulating layer comprises closed-cell polystyrene foam, and further wherein:

the insulating layer has a thickness between 0.375 inches and 0.75 inches;

the insulating layer extends continuously around the cylindrical body and the cap section; and the insulating layer is formed as a unitary piece with the cylindrical body and cap section to provide seamless insulation.

9. The insulated beverage holder of claim 1, wherein the freezable gel layer comprises one or more of: organic compounds, hypoallergenic compounds, non-toxic materials, environmentally friendly materials, hydroxyethyl cellulose, sodium polyacrylate, superabsorbent polymer, or silica gel.

10. The insulated beverage holder of claim 1, wherein the cap section comprises an elevated portion to accommodate bottles.

11. The insulated beverage holder of claim 1, wherein the containment shell of each of the base gel pack and the cap gel pack comprises:

a double-walled container with a hollow center, the gel material contained between the double walls; and an upper lip and a lower lip projecting away from the center of the containment shell to form rings encircling the top and bottom of the containment shell, respectively;

wherein the upper lip and the lower lip are configured to hold the insulating layer in place and prevent the insulating layer from sliding relative to the containment shell.

12. A method of using the insulated beverage holder of claim 1, comprising:

separating the freezable gel layer from the insulating layer;

placing the freezable gel layer in a freezer for a predetermined time to freeze the gel;

reinserting the frozen gel layer into the insulating layer within the cylindrical body;

opening the cap section relative to the base section;

inserting a beverage container into the hollow core of the cylindrical body; and closing and locking the cap section to the base section to secure the beverage container.

13. The method of claim 12, further comprising adjusting one or more compression rings within the hollow core to accommodate the size of the beverage container, wherein the one or more compression rings comprise a first silicone gel clasping ring at a top portion of the hollow core and a second silicone gel clasping ring at a bottom portion of the hollow core, the first and second silicone gel clasping rings providing a double seal around the beverage container.

14. The method of claim 12, further comprising grasping a handle coupled to an exterior of the base section while consuming a beverage from the beverage container.

15. The method of claim 14, further comprising adjusting the handle to provide a comfortable and fitted grip for a user by:

loosening fasteners securing the handle to the cylindrical body;

sliding the handle along recessed ribs to a desired position; and re-tightening the fasteners to secure the handle in the desired position.

16. The method of claim 12, wherein opening the cap section comprises pivoting the cap section about a hinge that couples the cap section to the base section.

17. The method of claim 16, wherein pivoting the cap section comprises actuating a thumb lever coupled to the hinge.

18. The method of claim 12, wherein closing and locking the cap section comprises engaging a locking mechanism to secure the cap section to the base section.

19. The method of claim 18, wherein the locking mechanism is selected from the group consisting of: a clasp, a catch, a latch, and a magnetic fastener.

20. The method of claim 19, further comprising unlocking and opening the cap section and consuming a beverage directly from the beverage container while the beverage container remains within the base section.

21. An insulated beverage holder for maintaining a cold temperature of a beverage, comprising:

a cylindrical body having a hollow core for receiving and directly holding the beverage, the cylindrical body comprising:

a base section; and a cap section hingedly coupled to the base section;

a removable freezable gel layer lining an interior of the hollow core and surrounding the beverage, the removable freezable gel layer comprising:

a base gel pack within the base section; and a cap gel pack within the cap section;

an insulating layer surrounding an exterior of the freezable gel layer; and a locking mechanism to secure the cap section to the base section in a closed position;

wherein the cylindrical body is adapted to accommodate various beverage volumes and bottle sizes.

22. The insulated beverage holder of claim 21, further comprising one or more adjustable compression rings coupled to the interior of the hollow core to secure and adapt to various bottle sizes, wherein the one or more adjustable compression rings comprise: a first silicone gel clasping ring installed at a top portion of the hollow core; a second silicone gel clasping ring installed at a bottom portion of the hollow core; and wherein the first and second silicone gel clasping rings have elasticity to adaptably grip outer walls of the beverage containers of different dimensions, providing improved fixed stability for the beverage containers.

* * * * *